US010435949B2

(12) United States Patent
Christianson et al.

(10) Patent No.: US 10,435,949 B2
(45) Date of Patent: Oct. 8, 2019

(54) COLLAPSIBLE STEPLADDER

(71) Applicants: Carl Christianson, Clearwater, FL (US); Frances M. Barker, Clearwater, FL (US)

(72) Inventors: Carl Christianson, Clearwater, FL (US); Frances M. Barker, Clearwater, FL (US)

( * ) Notice: Subject to any disclaimer, the term of this patent is extended or adjusted under 35 U.S.C. 154(b) by 0 days.

(21) Appl. No.: 15/798,633

(22) Filed: Oct. 31, 2017

(65) Prior Publication Data

US 2019/0128065 A1 May 2, 2019

(51) Int. Cl.

| | |
|---|---|
| ***E06C 7/18*** | (2006.01) |
| ***E06C 1/16*** | (2006.01) |
| ***E06C 7/50*** | (2006.01) |
| ***E06C 7/42*** | (2006.01) |

(52) U.S. Cl.

CPC ..... *E06C 7/183* (2013.01); *E06C 1/16* (2013.01); *E06C 7/182* (2013.01); *E06C 7/42* (2013.01); *E06C 7/50* (2013.01)

(58) Field of Classification Search

CPC . E06C 7/182; E06C 7/183; E06C 7/42; E06C 7/50; E06C 1/16

See application file for complete search history.

(56) References Cited

U.S. PATENT DOCUMENTS 396,886 A * 1/1889 Meisel ..... E06C 7/182 182/106
995,273 A * 6/1911 Mead ..... E06C 7/182 182/106
2,010,588 A * 8/1935 Gooden ..... E06C 7/182 182/106
2,656,088 A * 10/1953 White ..... E06C 7/182 182/106
2,988,164 A * 6/1961 Carlson ..... E06C 1/20 182/106
3,139,155 A 6/1964 Skeels
3,857,460 A * 12/1974 Nini ..... E06C 1/38 182/17
4,063,616 A 12/1977 Gutierrez
(Continued)

FOREIGN PATENT DOCUMENTS

DE 202014000803 U1 * 2/2014 ..... E06C 1/393
DE 202015001602 U1 * 7/2015 ..... E04G 25/04
(Continued)

*Primary Examiner* — Katherine W Mitchell
*Assistant Examiner* — Candace L Bradford

(57) ABSTRACT

The collapsible stepladder is a climbing structure that allows a person to increase their vertical elevation. The collapsible stepladder comprises a plurality of support stiles, a telescopic stile, a plurality of telescopic handrails, a plurality of steps, a plurality of detents, and a plurality of assembly hardware. The plurality of support stiles and the plurality of steps form the stepladder portion of the collapsible stepladder. The telescopic stile and the plurality of telescopic handrails are safety devices associated with the collapsible stepladder. The vertical height of both the plurality of telescopic handrails and the telescopic stile are adjustable such that safety grips are available at a vertical height appropriate for the elevation. The plurality of detents and the plurality of assembly hardware are used to assemble the collapsible stepladder.

11 Claims, 5 Drawing Sheets

(56) References Cited

U.S. PATENT DOCUMENTS

| | | | | | |
|---|---|---|---|---|---|
| 4,293,055 | A * | 10/1981 | Hooser | E06C 7/183 | 182/106 |
| 4,295,544 | A * | 10/1981 | Peterson | E06C 7/182 | 182/104 |
| 4,648,481 | A | 3/1987 | Lee | | |
| 4,711,282 | A | 12/1987 | Frazier | | |
| D335,354 | S | 5/1993 | Phillips | | |
| 5,577,574 | A * | 11/1996 | Joseph | E06C 1/18 | 182/104 |
| 6,443,261 | B1 * | 9/2002 | Gibson | E06C 1/16 | 182/104 |
| 7,383,920 | B2 | 6/2008 | Meeker | | |
| 2004/0000449 | A1 * | 1/2004 | Meeker | E06C 1/387 | 182/106 |
| 2005/0045423 | A1 * | 3/2005 | Meeker | E06C 1/393 | 182/165 |
| 2005/0284699 | A1 | 12/2005 | Fowler | | |
| 2011/0011674 | A1 * | 1/2011 | Kim | E06C 1/22 | 182/106 |
| 2012/0261214 | A1 | 10/2012 | Dondurur | | |

FOREIGN PATENT DOCUMENTS

| | | | | |
|---|---|---|---|---|
| DE | 202017000453 | U1 * | 2/2017 | E06C 1/387 |
| DE | 202017100664 | U1 * | 3/2017 | E06C 1/387 |
| FR | 2973827 | A1 * | 10/2012 | E06C 7/183 |

* cited by examiner

COLLAPSIBLE STEPLADDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including ladders, more specifically, a self-standing ladder with rigid longitudinal members, hinged struts, and telescopic components.

SUMMARY OF INVENTION

The collapsible stepladder is a climbing structure that allows a person to increase their vertical elevation. The collapsible stepladder comprises a plurality of support stiles, a telescopic stile, a plurality of telescopic handrails, a plurality of steps, a plurality of detents, and a plurality of assembly hardware. The plurality of support stiles and the plurality of steps form the stepladder portion of the collapsible stepladder. The telescopic stile and the plurality of telescopic handrails are safety devices associated with the collapsible stepladder. The vertical height of both the plurality of telescopic handrails and the telescopic stile are adjustable such that safety grips are available at a vertical height appropriate for the elevation. The plurality of detents and the plurality of assembly hardware are used to assemble the collapsible stepladder.

These together with additional objects, features and advantages of the collapsible stepladder will be readily apparent to those of ordinary skill in the art upon reading the following detailed description of the presently preferred, but nonetheless illustrative, embodiments when taken in conjunction with the accompanying drawings.

In this respect, before explaining the current embodiments of the collapsible stepladder in detail, it is to be understood that the collapsible stepladder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the collapsible stepladder.

It is therefore important that the claims be regarded as including such equivalent construction insofar as they do not depart from the spirit and scope of the collapsible stepladder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
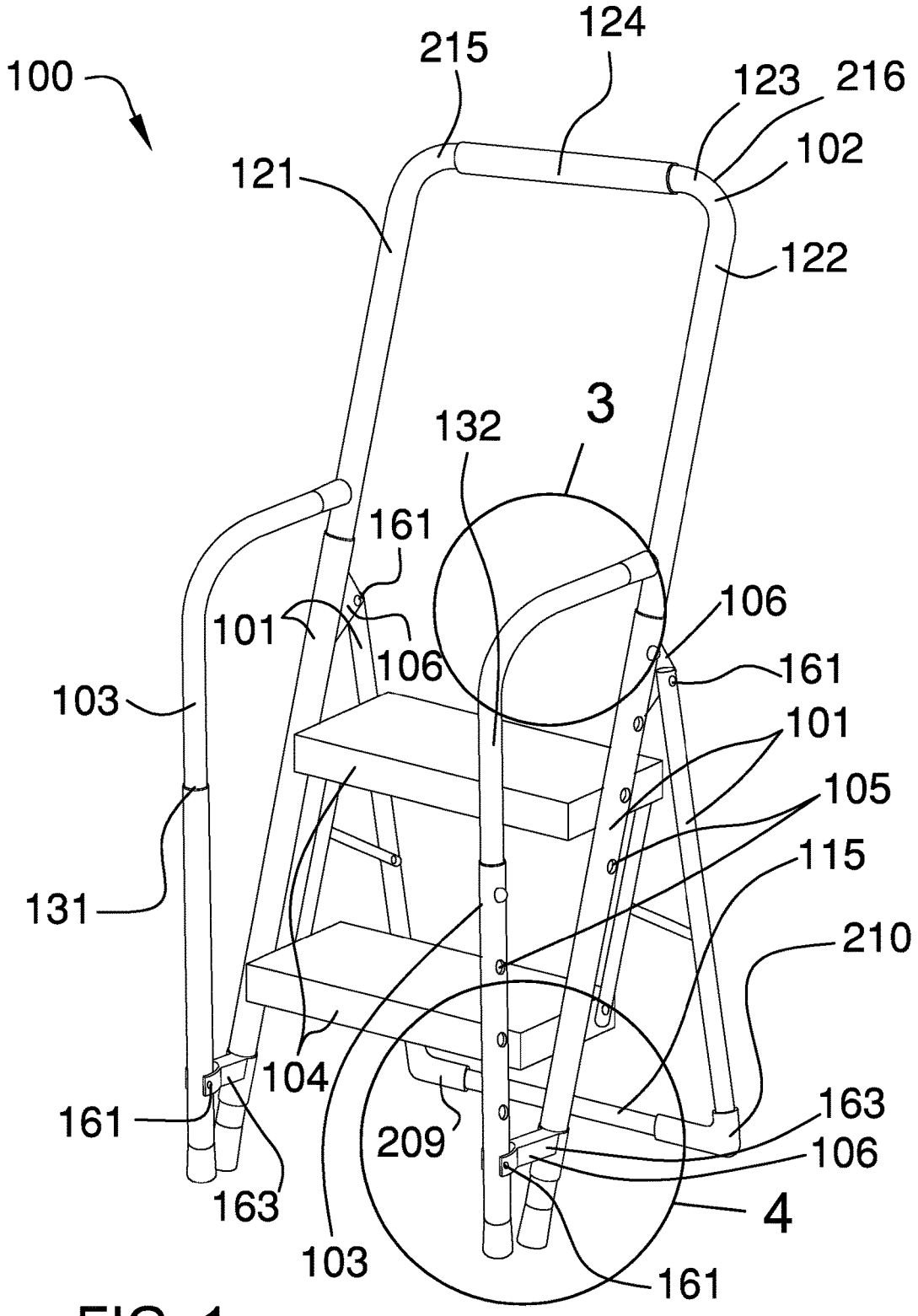
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The collapsible stepladder 100 (hereinafter invention) is a climbing structure that allows a person to increase their vertical elevation. The invention 100 comprises a plurality of support stiles 101, a telescopic stile 102, a plurality of telescopic handrails 103, a plurality of steps 104, a plurality of detents 105, and a plurality of assembly hardware 106. The plurality of support stiles 101 and the plurality of steps 104 form the stepladder portion of the invention 100. The telescopic stile 102 and the plurality of telescopic handrails 103 are safety devices associated with the invention 100. The vertical height of both the plurality of telescopic handrails 103 and the telescopic stile 102 are adjustable such that safety grips are available at a vertical height appropriate for the elevation. The plurality of detents 105 and the plurality of assembly hardware 106 are used to assemble the invention 100.

Within this disclosure, a supporting surface 191 is a horizontal surface upon which the invention 100 is placed for use.

Each of the plurality of support stiles 101 is a rail that provides the primary vertical support for the invention 100. The plurality of support stiles 101 perform a similar function to the stiles (also referred to rails) that are normally found on a commercially available stepladder.

The plurality of support stiles 101 comprises an anterior left stile 111, an anterior right stile 112, a posterior left stile 113, a posterior right stile 114, and a posterior cross brace 115. The anterior left stile 111 is further defined with a first end 201 and a second end 202. The anterior left stile 111 is further defined with an inner dimension. The anterior right stile 112 is further defined with a third end 203 and a fourth end 204. The anterior right stile 112 is further defined with an inner dimension. The posterior left stile 113 is further defined with a fifth end 205 and a sixth end 206. The posterior right stile 114 is further defined with a seventh end 207 and an eighth end 208. The posterior cross brace 115 is further defined with a ninth end 209 and a tenth end 210.

The anterior left stile 111 is a rigid hollow prism structure positioned on the left anterior side of the supporting structure of the invention 100. The anterior right stile 112 is a rigid hollow prism structure positioned on the right anterior side of the supporting structure of the invention 100. The posterior left stile 113 is a rigid prism structure positioned on the left posterior side of the supporting structure of the invention 100. The posterior right stile 114 is a rigid prism structure positioned on the right posterior side of the supporting structure of the invention 100. The posterior cross brace 115 is a rigid prism structure that forms the inferior posterior edge of the supporting structure of the invention 100.

The telescopic stile 102 is a hyoid shaped structure that attaches telescopically to a sub-plurality of stiles selected from the plurality of support stiles 101. The telescopic stile 102 is the superior structure of the invention 100. The vertical height of the telescopic stile 102 is adjustable to meet the safety needs of the person using the invention 100.

The telescopic stile 102 comprises a superior left stile 121, a superior right stile 122, and a top stile 123. The top stile 123 further comprises a neoprene grip 124. The superior left stile 121 is further defined with an eleventh end 211 and a twelfth end 212. The superior left stile 121 is further defined with an outer dimension. The superior right stile 122 is further defined with a thirteenth end 213 and a fourteenth end 214. The superior right stile 122 is further defined with an outer dimension. The top stile 123 is further defined with a fifteenth end 215 and a sixteenth end 216.

The superior left stile 121 is a rigid prism structure that attaches to the superior end of the anterior left stile 111 telescopically. The superior right stile 122 is a rigid prism structure that attaches to the superior end of the anterior right stile 112 telescopically. The top stile 123 forms the crossbar of the hyoid formed by the telescopic stile 102. The top stile 123 forms the superior edge of the invention 100 during normal use.

Each of the plurality of telescopic handrails 103 is a rotating structure that attaches to the plurality of support stiles 101. The vertical height of the plurality of telescopic handrails 103 is adjustable to meet the safety needs for the elevation provided by the invention 100. Each of the plurality of telescopic handrails 103 rotates relative to the plurality of support stiles 101. The rotation of each of the plurality of telescopic handrails 103 allows the plurality of telescopic handrails 103 to adjust to the selected vertical height of the telescopic stile 102. This rotation allows the plurality of telescopic handrails 103 in combination with the telescopic stile 102 to form a safety cage around the person using the invention 100.

The plurality of telescopic handrails 103 comprises a left handrail 131 and a right handrail 132. The left handrail 131 comprises a left inferior arm 133 and a left superior arm 134. The left inferior arm 133 is further defined with a seventeenth end 217 and an eighteenth end 218. The left superior arm 134 is further defined with a nineteenth end 219 and a twentieth end 220. The left inferior arm 133 is further defined with an inner dimension. The left superior arm 134 is further defined with an outer dimension. The left inferior arm 133 is a rigid hollow prism structure positioned on the left side of the invention 100. The left superior arm 134 is a rigid prism structure. The left superior arm 134 is formed with a right angle.

The right handrail 132 comprises a right inferior arm 135 and a right superior arm 136. The right inferior arm 135 is further defined with a twenty-first end 221 and a twenty-second end 222. The right inferior arm 135 is further defined with an inner dimension. The right superior arm 136 is further defined with a twenty-third end 223 and a twenty-fourth end 224. The right superior arm 136 is further defined with an outer dimension. The right inferior arm 135 is a rigid hollow prism structure positioned on the right side of the invention 100. The right superior arm 136 is a rigid prism structure. The right superior arm 136 is formed with a right angle.

Each of the plurality of steps 104 forms a horizontal surface that allows the person to use the invention 100 to ascend vertically. Each of the plurality of steps 104 rotates such that the invention 100 can collapse in the manner of a stepladder. Methods to attach a plurality of steps 104 to a plurality of support stiles 101 to form a collapsible structure are well known in the mechanical arts. In the first potential embodiment of the disclosure, the plurality of steps 104 comprises an inferior step 141 and a superior step 142.

In the first potential embodiment of the disclosure, the inferior step 141 and the superior step 142 are the only two steps disclosed in this disclosure. For the reasons discussed elsewhere, the use of the inferior step 141 and the superior step 142 should not be construed to limit the scope of the specification in this disclosure or the claims of this disclosure.

The inferior step 141 is the inferior horizontal surface of the invention 100 upon which the person steps. The inferior step 141 further comprises a left spreader 143. The left spreader 143 comprises a left spreader brace 171, a left step brace 172, and a left pivot 173. The left spreader brace 171 is further defined with a twenty-fifth end 225 and a twenty-sixth end 226. The left step brace 172 is further defined with a twenty-seventh end 227 and a twenty-eighth end 228.

The superior step 142 is the superior horizontal surface of the invention 100 upon which the person steps. The superior step 142 further comprises a right spreader 144. The right spreader 144 comprises a right spreader brace 174, a right step brace 175, and a right pivot 176. The right spreader brace 174 is further defined with a twenty-ninth end 229 and a thirtieth end 230. The right step brace 175 is further defined with a thirty-first end 231 and a thirty-second end 232.

The left spreader 143 is a structure that: 1) braces the anterior left stile 111 to the posterior left stile 113; 2) supports each of the plurality of steps 104 when the invention 100 is used normally; and, 3) rotates the plurality of steps 104 into a storage position when the invention 100 is collapsed. The left spreader brace 171 is a commercially available flat iron. The left step brace 172 is a commercially available flat iron. The left pivot 173 is a shaft that attaches the left spreader brace 171 to the left step brace 172 such that the left spreader brace 171 will rotate relative to the left step brace 172.

The right spreader 144 is a structure that: 1) braces the anterior right stile 112 to the posterior right stile 114; 2) supports each of the plurality of steps 104 when the invention 100 is used normally; and, 3) rotates the plurality of steps 104 into a storage position when the invention 100 is collapsed. The right spreader brace 174 is a commercially available flat iron. The right step brace 175 is a commercially available flat iron. The right pivot 176 is a shaft that attaches the right spreader brace 174 to the right step brace 175 such that the right spreader brace 174 will rotate relative to the right step brace 175.

The use of a left spreader 143 and a right spreader 144 on a stepladder is well known and documented in the mechanical arts.

Those skilled in the art will recognize that the left step brace 172 of the left spreader 143 and the right step brace 175 of the right spreader 144 can be modified to accommodate additional steps in the plurality of steps 104 without undue experimentation. Those skilled in the art will recognize that the attachment of additional steps to the anterior left stile 111 and the anterior right stile 112 can be modified to accommodate additional steps in the plurality of steps 104 without undue experimentation.

The plurality of detents 105 are commercially available detents that are used to lock the telescopic structures of the invention 100 into position. The details of the implementation of the plurality of detents 105 are discussed in greater detail elsewhere in this disclosure. The plurality of detents 105 comprises a first detent 151, a second detent 152, a third detent 153, and a fourth detent 154.

The plurality of assembly hardware 106 are commercially available hardware items that are used to assemble the invention 100. The details of the plurality of assembly hardware 106 are discussed in greater detail elsewhere in this disclosure.

The plurality of assembly hardware 106 comprises a plurality of hinges 161, a plurality of hinge plates 162, and a plurality of hinge extensions 163.

Each of the plurality of hinges 161 is a locking hinge. Each of the plurality of hinges 161 is used to: 1) interconnect the individual stiles and the individual handrails contained within the plurality of support stiles 101 and the plurality of telescopic handrails 103 respectively; and 2) locks the invention 100 into a fixed position when the invention 100 is used normally. The plurality of hinges 161 are discussed in greater detail elsewhere in this disclosure. The plurality of hinges 161 comprises a first hinge 181, a second hinge 182, a third hinge 183, and a fourth hinge 184. The first hinge 181 is a commercially available locking hinge. The second hinge 182 is a commercially available locking hinge. The third hinge 183 is a commercially available locking hinge. The fourth hinge 184 is a commercially available locking hinge.

Each of the plurality of hinge plates 162 is a metal plate that attaches to a stile selected from the plurality of support stiles 101. The plurality of hinge plates 162 comprises a left hinge plate 185 and a right hinge plate 186. The left hinge plate 185 is a commercially available flat metal plate. The right hinge plate 186 is a commercially available flat metal plate.

Each of the plurality of hinge extensions 163 is a rigid prism structure that interconnects two stiles selected from the plurality of support stiles 101. The plurality of hinge extensions 163 comprises a left hinge extension 187 and a right hinge extension 188. The left hinge extension 187 is further defined with a thirty-third end 233 and a thirty-fourth end 234. The right hinge extension 188 is further defined with a thirty-fifth end 235 and a thirty-sixth end 236. The left hinge extension 187 is a rigid prism structure. The right hinge extension 188 is a rigid prism structure.

The following eight paragraphs describe the telescopic nature of this disclosure.

The anterior left stile 111 and the superior left stile 121 form a first telescopic structure. The anterior left stile 111 and the superior left stile 121 are geometrically similar. The outer dimension of the superior left stile 121 is lesser than the inner dimension of the anterior left stile 111 such that the superior left stile 121 inserts into the anterior left stile 111. This telescopic arrangement allows the span of the superior left stile 121 and the anterior left stile 111 to be adjusted by adjusting the relative position of the superior left stile 121 within the anterior left stile 111.

The position of the superior left stile 121 relative to the anterior left stile 111 is locked in position using the first detent 151. The first detent 151 is a mechanical device that connects and secures the superior left stile 121 to the anterior left stile 111. The first detent 151 is selected from the group consisting of a cotter pin, a G snap collar, a cam lock collar, a threaded clutch, a split collar lock, or a spring loaded ball lock. In the first potential embodiment of the disclosure, the first detent 151 is a spring loaded ball lock.

The anterior right stile 112 and the superior right stile 122 form a first telescopic structure. The anterior right stile 112 and the superior right stile 122 are geometrically similar. The outer dimension of the superior right stile 122 is lesser than the inner dimension of the anterior right stile 112 such that the superior right stile 122 inserts into the anterior right stile 112. This telescopic arrangement allows the span of the superior right stile 122 and the anterior right stile 112 to be adjusted by adjusting the relative position of the superior right stile 122 within the anterior right stile 112.

The position of the superior right stile 122 relative to the anterior right stile 112 is locked in position using the second detent 152. The second detent 152 is a mechanical device that connects and secures the superior right stile 122 to the anterior right stile 112. The second detent 152 is selected from the group consisting of a cotter pin, a G snap collar, a cam lock collar, a threaded clutch, a split collar lock, or a spring loaded ball lock. In the first potential embodiment of the disclosure, the second detent 152 is a spring loaded ball lock.

The left handrail 131 is a third telescopic structure. The left inferior arm 133 and the left superior arm 134 are geometrically similar. The outer dimension of the left superior arm 134 is lesser than the inner dimension of the left inferior arm 133 such that the left superior arm 134 inserts into the left inferior arm 133. This telescopic arrangement of the left handrail 131 allows the length of the left handrail 131 to be adjusted by adjusting the relative position of the left superior arm 134 within the left inferior arm 133.

The position of the left superior arm 134 relative to the left inferior arm 133 is locked in position using the third detent 153. The third detent 153 is a mechanical device that connects and secures the left superior arm 134 to the left inferior arm 133. The third detent 153 is selected from the group consisting of a cotter pin, a G snap collar, a cam lock collar, a threaded clutch, a split collar lock, or a spring loaded ball lock. In the first potential embodiment of the disclosure, the third detent 153 is a spring loaded ball lock.

The right handrail 132 is a fourth telescopic structure. The right inferior arm 135 and the right superior arm 136 are geometrically similar. The outer dimension of the right superior arm 136 is lesser than the inner dimension of the right inferior arm 135 such that the right superior arm 136 inserts into the right inferior arm 135. This telescopic arrangement of the right handrail 132 allows the length of the right handrail 132 to be adjusted by adjusting the relative position of the right superior arm 136 within the right inferior arm 135.

The position of the right superior arm 136 relative to the right inferior arm 135 is locked in position using the fourth detent 154. The fourth detent 154 is a mechanical device that connects and secures the right superior arm 136 to the right inferior arm 135. The fourth detent 154 is selected from the group consisting of a cotter pin, a G snap collar, a cam lock collar, a threaded clutch, a split collar lock, or a spring loaded ball lock. In the first potential embodiment of the disclosure, the fourth detent 154 is a spring loaded ball lock.

The following seven paragraphs describe the assembly of the invention 100.

The left hinge plate 185 attaches to the anterior left stile 111 at a location proximal to the second end 202 such that the left hinge plate 185 projects away from the anterior left stile 111 in the posterior direction. The right hinge plate 186 attaches to the anterior right stile 112 at a location proximal to the fourth end 204 such that the right hinge plate 186 projects away from the anterior right stile 112 in the posterior direction. The thirty-third end 233 of the left hinge extension 187 attaches to the lateral face of the anterior left stile 111 proximal to the first end 201. The thirty-fifth end 235 of the right hinge extension 188 attaches to the lateral face of the posterior right stile 114 proximal to the third end 203.

The first hinge 181 attaches the sixth end 206 of the posterior left stile 113 to the left hinge plate 185. The second hinge 182 attaches the eighth end 208 of the posterior right stile 114 to the right hinge plate 186. The third hinge 183 attaches the thirty-fourth end 234 of the left hinge extension 187 to the lateral face of the left inferior arm 133 proximal to the seventeenth end 217. The fourth hinge 184 attaches the thirty-sixth end 236 of the right hinge extension 188 to the lateral face of the right inferior arm 135 proximal to the twenty-first end 221.

The eleventh end 211 of the superior left stile 121 inserts into the second end 202 of the anterior left stile 111. The thirteenth end 213 of the superior right stile 122 inserts into the fourth end 204 of the anterior right stile 112. The ninth end 209 of the posterior cross brace 115 attaches to the fifth end 205 of the posterior left stile 113. The tenth end 210 of the posterior cross brace 115 attaches to the seventh end 207 of the posterior right stile 114. The twelfth end 212 of the superior left stile 121 attaches to the fifteenth end 215 of the top stile 123. The fourteenth end 214 of the superior right stile 122 attaches to the sixteenth end 216 of the top stile 123.

The nineteenth end 219 of the left superior arm 134 inserts into the eighteenth end 218 of the left inferior arm 133. The twenty-third end 223 of the right superior arm 136 inserts into the twenty-second end 222 of the right inferior arm 135.

The twenty-fifth end 225 of the left spreader brace 171 uses a locking pivot to attach to the lateral face of the posterior left stile 113 such that the left spreader brace 171 rotates around the twenty-fifth end 225. The left pivot 173 attaches the twenty-sixth end 226 of the left spreader brace 171 to the center of the left step brace 172 such that the left spreader 143 will rotate. The twenty-seventh end 227 of the left step brace 172 attaches to the inferior step 141 such that the inferior step 141 will rotate. The twenty-eighth end 228 of the left step brace 172 attaches to the superior step 142 such that the superior step 142 will rotate.

The twenty-ninth end 229 of the right spreader brace 174 uses a locking pivot to attach to the lateral face of the posterior right stile 114 such that the right spreader brace 174 rotates around the twenty-ninth end 229. The right pivot 176 attaches the thirtieth end 230 of the right spreader brace 174 to the center of the right step brace 175 such that the right spreader 144 will rotate.

The thirty-first end 231 of the right step brace 175 attaches to the inferior step 141 such that the inferior step 141 will rotate. The thirty-second end 232 of the right step brace 175 attaches to the superior step 142 such that the superior step 142 will rotate.

The following two paragraphs describe the use of the invention 100.

Figure 2:
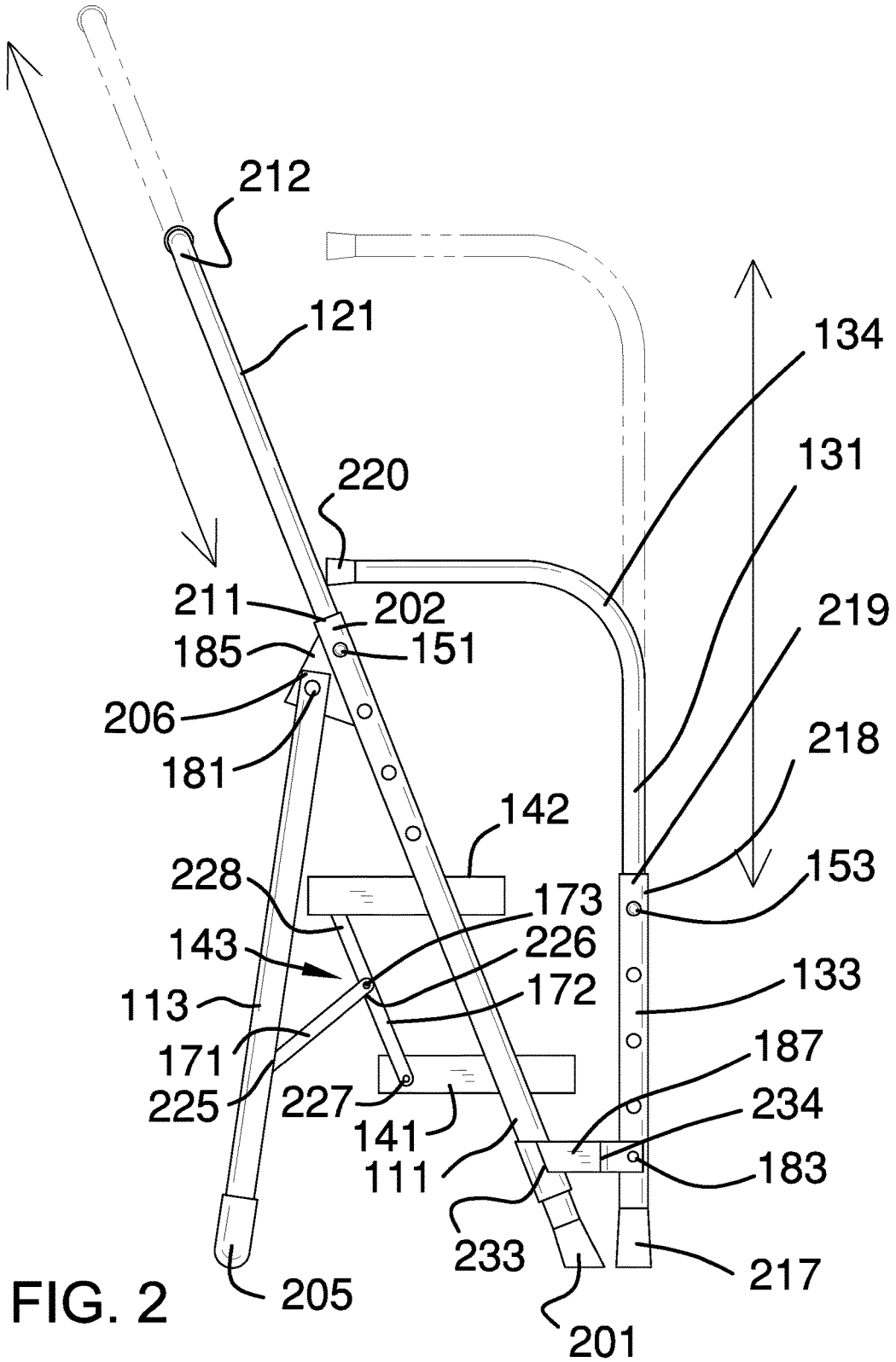
FIG. 2 is a left side view of an embodiment of the disclosure.
Figure 3:
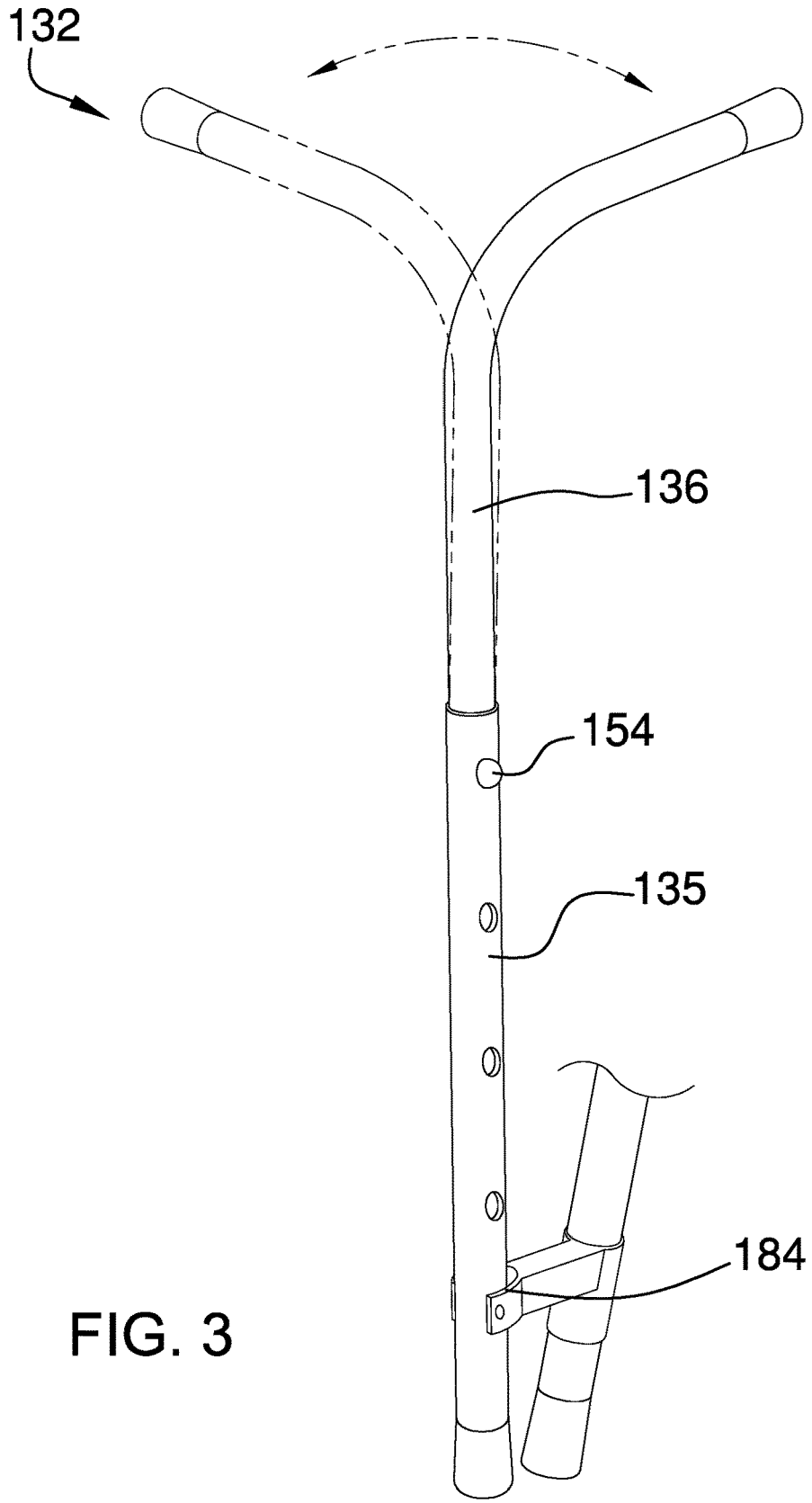
FIG. 3 is a detail view of an embodiment of the disclosure.
Figure 4:
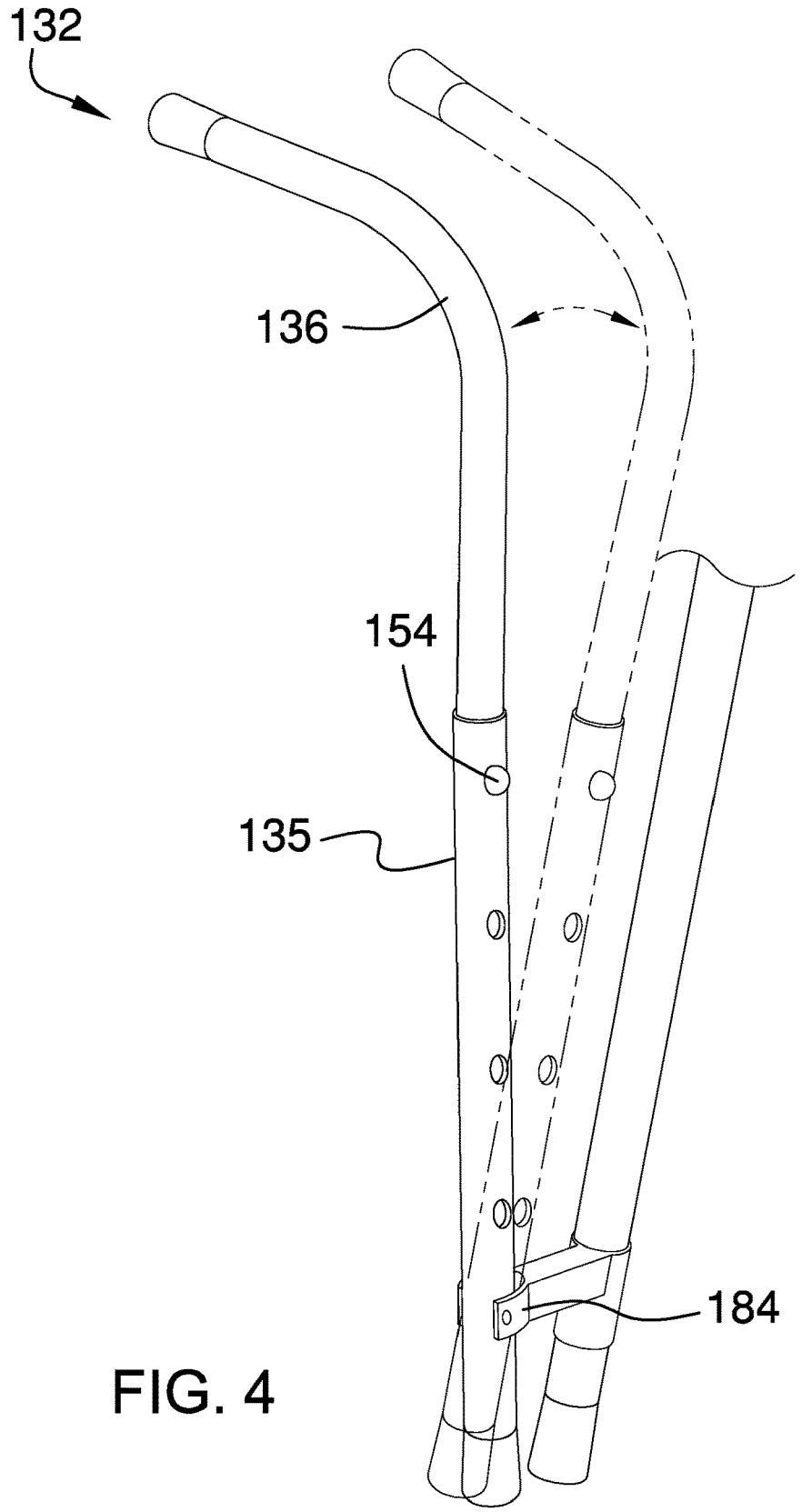
FIG. 4 is a detail view of an embodiment of the disclosure.
Figure 5:
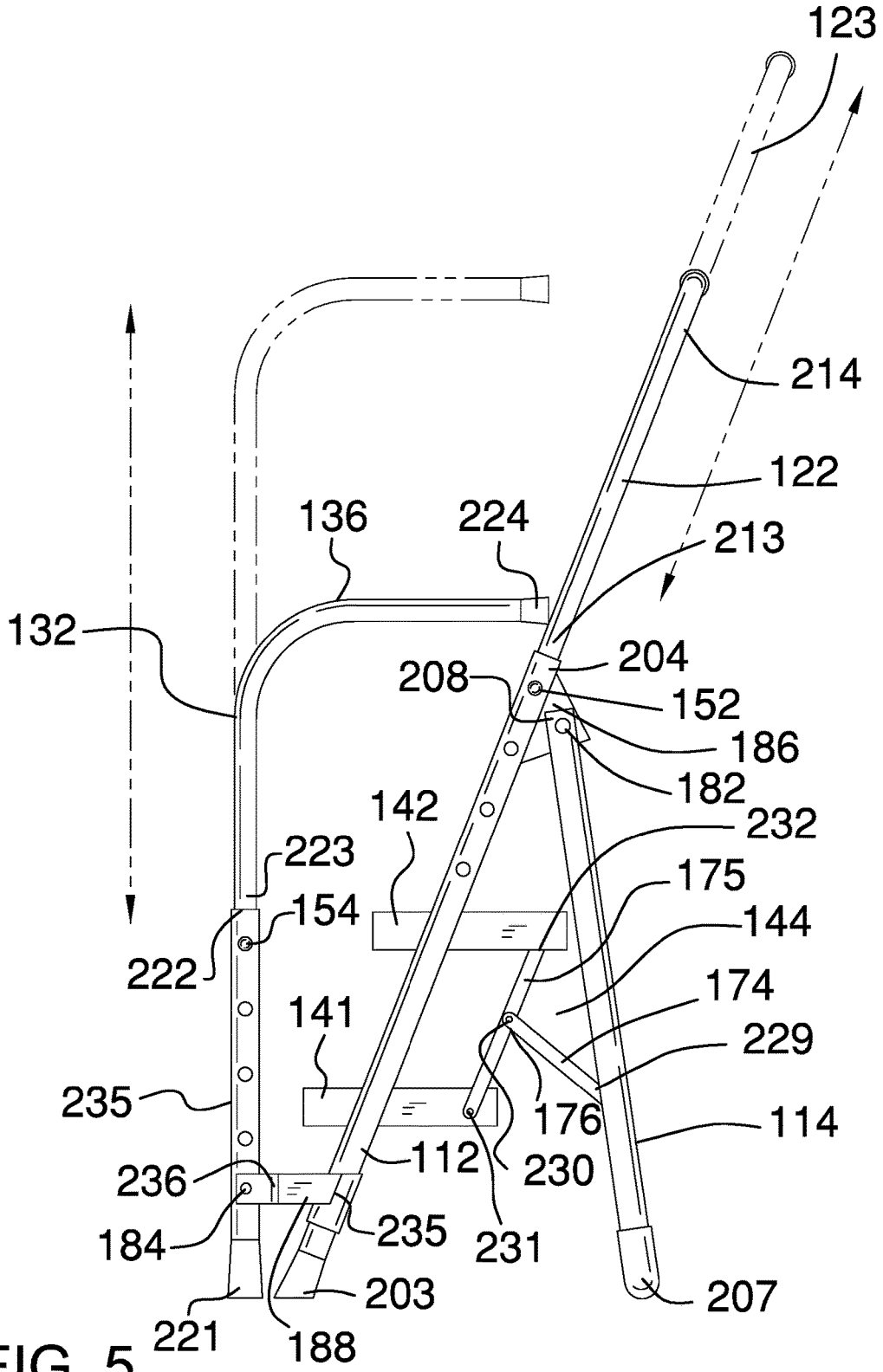
FIG. 5 is a right side view of an embodiment of the disclosure.

After the assembly of the invention 100, as shown most clearly in FIGS. 2 and 5, the first end 201 of the anterior left stile 111 rests on the supporting surface 191. The third end 203 of the anterior right stile 112 rests on the supporting surface 191. The fifth end 205 of the posterior left stile 113 rests on the supporting surface 191. The seventh end 207 of the posterior right stile 114 rests on the supporting surface 191. The seventeenth end 217 of the left inferior arm 133 rests on the supporting surface 191. The twenty-first end 221 of the right inferior arm 135 rests on the supporting surface 191.

The left handrail 131 is rotated such that the twentieth end 220 of the left superior arm 134 rests against the lateral face of the superior left stile 121. The right handrail 132 is rotated such that the twenty-fourth end 224 of the right superior arm 136 rests against the lateral face of the superior right stile 122.

The following definitions and directional references were used in this disclosure:

Anterior: As used in this disclosure, anterior is a term that is used to refer to the front side or direction of a structure. When comparing two objects, the anterior object is the object that is closer to the front of the structure.

Correspond: As used in this disclosure, the term correspond is used as a comparison between two or more objects wherein one or more properties shared by the two or more objects match, agree, or align almost exactly.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Detent: As used in this disclosure, a detent is a device for positioning and holding a first object relative to a second object such that the position of the first object relative to the second object is adjustable.

Extension Structure: As used in this disclosure, an extension structure is an inert physical structure that is used to extend the span of the distance between any two objects.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three-sided structure comprising a crossbeam, a first arm and a second arm. In a hyoid, the first arm and the second arm project away from the crossbeam: 1) in the same direction; 2) at a roughly perpendicular angle to the crossbeam, and, 3)

the span of length of the first arm roughly equals the span of length of the second arm. Hyoids generally have a U shaped appearance.

Inferior: As used in this disclosure, the term inferior refers to a directional reference that is parallel to and in the same direction as the force of gravity.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lock: As used in this disclosure, a lock is a fastening device that secures a rotating mechanical device into a fixed position.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and, 2) that appears thin relative to the other dimensions of the object. Plates often have a rectangular or disk-like appearance. As defined in this disclosure, plates may be made of any material, but are commonly made of metal. When made of wood, a plate is often referred to as a board.

Posterior: As used in this disclosure, posterior is a term that is used to refer to the side of an object that is distal or in the opposite direction of the anterior side. When comparing two items, the posterior item is the item that is distal from the front of the object.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Telescopic: As used in this disclosure, telescopic is an adjective that describes an object made of sections that fit or slide into each other such that the object can be made longer or shorter by adjusting the relative positions of the sections.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

The directional references used in this disclosure correspond to the directional references from the perspective of a person facing the plurality of steps in preparation for use of the disclosed device. As such, left refers to the direction towards the left side of the person and right refers to the direction towards the right side of the person. Superior refers to the direction towards the head of the wearer and inferior refers to the direction towards the feet of the wearer. Anterior refers to the side of the disclosed device that is proximal to the person and posterior refers side of the disclosed device that is distal from the anterior side.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A self-standing ladder comprising:

a plurality of support stiles, a telescopic stile, a plurality of telescopic handrails, a plurality of steps, a plurality of detents, and a plurality of assembly hardware;

wherein the telescopic stile and the plurality of telescopic handrails are safety devices;

wherein the plurality of detents and the plurality of assembly hardware are used to assemble the self-standing ladder;

wherein a vertical height of both the plurality of telescopic handrails and the telescopic stile are adjustable such that the telescopic stile and the plurality of telescopic handrails safety form a plurality of grips at a vertical height;

wherein each of the plurality of telescopic handrails is a rotating structure;

wherein each of the plurality of telescopic handrails attaches to a respective one the plurality of support stiles;

wherein the vertical height of the plurality of telescopic handrails is adjustable;

wherein each of the plurality of telescopic handrails rotates relative to the respective one of the plurality of support stiles;

wherein the telescopic stile is a hyoid shaped structure;

wherein the plurality of support stiles are further defined with the plurality of telescopic stiles and a sub-plurality of stiles;

wherein the telescopic stile is the superior structure of the self-standing ladder;

wherein the vertical height of the telescopic stile is adjustable;

wherein each of the plurality of steps forms a respective horizontal surface;

wherein each of the plurality of steps rotates;

wherein the plurality of assembly hardware comprises a plurality of hinges, a plurality of hinge plates, and a plurality of hinge extensions;

wherein each of the plurality of hinges interconnects an individual stile and an individual handrail contained within the plurality of support stiles and the plurality of telescopic handrails respectively;

wherein each of the plurality of hinges locks the self-standing ladder into a fixed position;

wherein each of the plurality of hinge plates is a metal plate that attaches to a stile selected from the plurality of support stiles;

wherein each of the plurality of hinge extensions is a rigid prism structure that interconnects two stiles selected from the plurality of support stiles;

wherein each the plurality of detents is a mechanical device that locks a telescopic structure of the self-standing ladder into position;

wherein the plurality of support stiles comprises an anterior left stile, an anterior right stile, a posterior left stile, a posterior right stile, and a posterior cross brace;

wherein the anterior left stile attaches to the posterior left stile;

wherein the anterior right stile attaches to the posterior right stile;

wherein the posterior cross brace attaches the posterior left stile to the posterior right stile;

wherein the anterior left stile is further defined with a first end and a second end;

wherein the anterior left stile is further defined with an inner dimension;

wherein the anterior right stile is further defined with a third end and a fourth end;

wherein the anterior right stile is further defined with an inner dimension;

wherein the posterior left stile is further defined with a fifth end and a sixth end;

wherein the posterior right stile is further defined with a seventh end and an eighth end;

wherein the posterior cross brace is further defined with a ninth end and a tenth end;

wherein the telescopic stile comprises a superior left stile, a superior right stile, and a top stile;

wherein the top stile attaches the superior left stile to the superior right stile;

wherein the superior left stile is further defined with an eleventh end and a twelfth end;

wherein the superior left stile is further defined with an outer dimension;

wherein the superior right stile is further defined with a thirteenth end and a fourteenth end;

wherein the superior right stile is further defined with an outer dimension;

wherein the top stile is further defined with a fifteenth end and a sixteenth end;

wherein the anterior left stile is positioned on the left anterior side of the self-standing ladder;

wherein the anterior right stile is positioned on the right anterior side of the self-standing ladder;

wherein the posterior left stile is positioned on the left posterior side of the self-standing ladder;

wherein the posterior right stile is positioned on the right posterior side of the of the self-standing ladder;

wherein the posterior cross brace is a rigid prism structure;

wherein the posterior cross brace forms the inferior posterior edge of the self-standing ladder;

wherein the superior left stile attaches to the superior end of the anterior left stile telescopically;

wherein the superior right stile attaches to the superior end of the anterior right stile telescopically;

wherein the top stile forms the crossbar of the hyoid formed by the telescopic stile;

wherein the top stile forms the superior edge of the self-standing ladder;

wherein the plurality of steps further comprises a left spreader and a right spreader;

wherein the left spreader comprises a left spreader brace, a left step brace, and a left pivot;

wherein the left spreader brace attaches the left step brace to a posterior left stile;

wherein the left pivot attaches the left step brace to the left spreader brace;

wherein the left step brace attaches to each of the plurality of steps;

wherein the right spreader comprises a right spreader brace, a right step brace, and a right pivot;

wherein the right spreader brace attaches the right step brace to a posterior right stile;

wherein the right pivot attaches the right step brace to the right spreader brace;

wherein the right step brace attaches to each of the plurality of steps;

wherein the plurality of telescopic handrails comprises a left handrail and a right handrail;

wherein the left handrail comprises a left inferior arm and a left superior arm;

wherein the right handrail comprises a right inferior arm and a right superior arm;

wherein the left inferior arm attaches to the left superior arm;

wherein the right inferior arm attaches to the right superior arm;

wherein the left inferior arm is further defined with a seventeenth end and an eighteenth end;

wherein the left superior arm is further defined with a nineteenth end and a twentieth end;

wherein the left inferior arm is further defined with an inner dimension;

wherein the left superior arm is further defined with an outer dimension;

wherein the right inferior arm is further defined with a twenty-first end and a twenty-second end;

wherein the right inferior arm is further defined with an inner dimension;

wherein the right superior arm is further defined with a twenty-third end and a twenty-fourth end;

wherein the right superior arm is further defined with an outer dimension;

wherein the left spreader brace is further defined with a twenty-fifth end and a twenty-sixth end;

wherein the left step brace is further defined with a twenty-seventh end and a twenty-eighth end;

wherein the right spreader brace is further defined with a twenty-ninth end and a thirtieth end;

wherein the right step brace is further defined with a thirty-first end and a thirty-second end.

2. The self-standing ladder according to claim 1 wherein the left inferior arm is a rigid hollow prism structure;

wherein the right inferior arm is a rigid hollow prism structure;

wherein the left superior arm is a rigid prism structure;

wherein the right superior arm is a rigid prism structure;

wherein the left inferior arm is positioned on the left side of the self-standing ladder;

wherein the right inferior arm is positioned on the right side of the self-standing ladder.

3. The self-standing ladder according to claim 2 wherein the left superior arm is formed with a right angle;

wherein the right superior arm is formed with a right angle.

4. The self-standing ladder according to claim 3 wherein the left spreader brace is a flat iron;

wherein the left step brace is a flat iron;

wherein the left pivot is a shaft that attaches the left spreader brace to the left step brace such that the left spreader brace will rotate relative to the left step brace;

wherein the right spreader brace is a flat iron;

wherein the right step brace is a flat iron;

wherein the right pivot is a shaft that attaches the right spreader brace to the right step brace such that the right spreader brace will rotate relative to the right step brace.

5. The self-standing ladder according to claim 4 wherein the anterior left stile and the superior left stile form a first telescopic structure;

wherein the outer dimension of the superior left stile is lesser than the inner dimension of the anterior left stile such that the superior left stile inserts into the anterior left stile;

wherein a span of the superior left stile and the anterior left stile is adjusted by adjusting the relative position of the superior left stile within the anterior left stile;

wherein a position of the superior left stile relative to the anterior left stile is locked in position using a first detent selected from the plurality of detents;

wherein the first detent connects and secures the superior left stile to the anterior left stile.

6. The self-standing ladder according to claim 5 wherein the anterior right stile and the superior right stile form a second telescopic structure;

wherein the outer dimension of the superior right stile is lesser than the inner dimension of the anterior right stile such that the superior right stile inserts into the anterior right stile;

wherein a span of the superior right stile and the anterior right stile is adjusted by adjusting the relative position of the superior right stile within the anterior right stile;

wherein a position of the superior right stile relative to the anterior right stile is locked in position using a second detent selected from the plurality of detents;

wherein the second detent connects and secures the superior right stile to the anterior right stile.

7. The self-standing ladder according to claim 6 wherein the left handrail is a third telescopic structure;

wherein the outer dimension of the left superior arm is lesser than the inner dimension of the left inferior arm such that the left superior arm inserts into the left inferior arm;

wherein the span of the length of the left handrail is adjusted by adjusting the relative position of the left superior arm within the left inferior arm;

wherein the position of the left superior arm relative to the left inferior arm is locked in position using a third detent selected from the plurality of detents;

wherein the third detent is a mechanical device that connects and secures the left superior arm to the left inferior arm.

8. The self-standing ladder according to claim 7 wherein the right handrail is a fourth telescopic structure;

wherein the right inferior arm and the right superior arm are geometrically similar;

wherein the outer dimension of the right superior arm is lesser than the inner dimension of the right inferior arm such that the right superior arm inserts into the right inferior arm;

wherein the span of the length of the right handrail is adjusted by adjusting the relative position of the right superior arm within the right inferior arm;

wherein the position of the right superior arm relative to the right inferior arm is locked in position using a fourth detent selected from the plurality of detents;

wherein the fourth detent is a mechanical device that connects and secures the right superior arm to the right inferior arm.

9. The self-standing ladder according to claim 8 wherein the plurality of detents comprises a first detent, a second detent, a third detent, and a fourth detent;

wherein the plurality of hinges comprises a first hinge, a second hinge, a third hinge, and a fourth hinge;

wherein the first hinge is a locking hinge;

wherein the second hinge is a locking hinge;

wherein the third hinge is a locking hinge;

wherein the fourth hinge is a locking hinge;

wherein the plurality of hinge plates comprises a left hinge plate and a right hinge plate;

wherein the left hinge plate is a flat metal plate;

wherein the right hinge plate is a flat metal plate;

wherein the plurality of hinge extensions comprises a left hinge extension and a right hinge extension;

wherein the left hinge extension is a rigid prism structure;

wherein the right hinge extension is a rigid prism structure;

wherein the left hinge extension is further defined with a thirty-third end and a thirty-fourth end;

wherein the right hinge extension is further defined with a thirty-fifth end and a thirty-sixth end.

10. The self-standing ladder according to claim 9 wherein the left hinge plate attaches to the anterior left stile such that the left hinge plate projects away from the anterior left stile in the posterior direction;

wherein the right hinge plate attaches to the anterior right stile such that the right hinge plate projects away from the anterior right stile in the posterior direction;

wherein the thirty-third end of the left hinge extension attaches to the lateral face of the anterior left stile;

wherein the thirty-fifth end of the right hinge extension attaches to the lateral face of the posterior right stile;

wherein the first hinge attaches the sixth end of the posterior left stile to the left hinge plate;

wherein the second hinge attaches the eighth end of the posterior right stile to the right hinge plate;

wherein the third hinge attaches the thirty-fourth end of the left hinge extension to the lateral face of the left inferior arm;

wherein the fourth hinge attaches the thirty-sixth end of the right hinge extension to the lateral face of the right inferior arm;

wherein the eleventh end of the superior left stile inserts into the second end of the anterior left stile;

wherein the thirteenth end of the superior right stile inserts into the fourth end of the anterior right stile;

wherein the ninth end of the posterior cross brace attaches to the fifth end of the posterior left stile;

wherein the tenth end of the posterior cross brace attaches to the seventh end of the posterior right stile;

wherein the twelfth end of the superior left stile attaches to the fifteenth end of the top stile;

wherein the fourteenth end of the superior right stile attaches to the sixteenth end of the top stile;

wherein the nineteenth end of the left superior arm inserts into the eighteenth end of the left inferior arm;

wherein the twenty-third end of the right superior arm inserts into the twenty-second end of the right inferior arm;

wherein the twenty-fifth end of the left spreader brace uses a locking pivot to attach to the lateral face of the posterior left stile such that the left spreader brace rotates around the twenty-fifth end;

wherein the left pivot attaches the twenty-sixth end of the left spreader brace to the center of the left step brace such that the left spreader rotates;

wherein the twenty-seventh end of the left step brace attaches to the inferior step such that the inferior step rotates;

wherein the twenty-eighth end of the left step brace attaches to the superior step such that the superior step rotates;

wherein the twenty-ninth end of the right spreader brace uses a locking pivot to attach to the lateral face of the posterior right stile such that the right spreader brace rotates around the twenty-ninth end;

wherein the right pivot attaches the thirtieth end of the right spreader brace to the center of the right step brace such that the right spreader rotates;

wherein the thirty-first end of the right step brace attaches to the inferior step such that the inferior step rotates;

wherein the thirty-second end of the right step brace attaches to the superior step such that the superior step rotates.

11. The self-standing ladder according to claim 10 wherein the left handrail is rotated such that the twentieth end of the left superior arm rests against the lateral face of the superior left stile;

wherein the right handrail is rotated such that the twenty-fourth end of the right superior arm rests against the lateral face of the superior right stile;

wherein the first detent is a spring loaded ball lock;

wherein the second detent is a spring loaded ball lock;

wherein the third detent is a spring loaded ball lock;

wherein the fourth detent is a spring loaded ball lock;

wherein the top stile further comprises a neoprene grip.

* * * * *